US010092042B2

(12) United States Patent
Samuel

(10) Patent No.: US 10,092,042 B2
(45) Date of Patent: Oct. 9, 2018

(54) PADDED UNDERGARMENT

(71) Applicant: SAMBITION ENTERPRISES, LLC, Miami Beach, FL (US)

(72) Inventor: Ryan Samuel, Miami Beach, FL (US)

( * ) Notice: Subject to any disclaimer, the term of this patent is extended or adjusted under 35 U.S.C. 154(b) by 0 days.

(21) Appl. No.: 14/026,499

(22) Filed: Sep. 13, 2013

(65) Prior Publication Data

US 2015/0075538 A1 Mar. 19, 2015

(51) Int. Cl.

| | |
|---|---|
| ***A41B 9/02*** | (2006.01) |
| ***A41B 9/12*** | (2006.01) |
| *A63B 71/12* | (2006.01) |
| *A41D 13/05* | (2006.01) |

(52) U.S. Cl.

CPC ..... *A41B 9/12* (2013.01); *A41B 9/02* (2013.01); *A41D 13/0537* (2013.01); *A63B 71/12* (2013.01)

(58) Field of Classification Search

CPC ..... A63B 71/1216; A41B 9/06; A41B 9/08; A41B 9/001; A41B 9/04; A41D 1/16; A43B 9/12; A43B 9/02

USPC ..... 2/400, 215, 401, 403

See application file for complete search history.

(56) References Cited

U.S. PATENT DOCUMENTS

| | | | | |
|---|---|---|---|---|
| 1,468,072 | A | 9/1923 | Ogle | |
| 2,332,141 | A | 10/1943 | Greene | |
| 2,807,805 | A | 10/1957 | Allan | |
| 3,295,530 | A | 1/1967 | Mayer et al. | |
| 3,524,448 | A | 8/1970 | Parco | |
| 4,805,243 | A | 2/1989 | Gibbens et al. | |
| 4,894,867 | A | 1/1990 | Ceravolo et al. | |
| 4,969,216 | A | 11/1990 | Guelli | |
| 4,984,304 | A | 1/1991 | Brown | |
| 5,103,505 | A | 4/1992 | Llorens | |
| 5,513,393 | A | 5/1996 | Ferreira et al. | |
| 5,749,101 | A | 5/1998 | Breindel | |
| 5,842,232 | A | 12/1998 | Parrish | |
| 6,182,297 | B1 | 2/2001 | Duren et al. | |
| 6,393,618 | B2 | 5/2002 | Garneau | |
| 6,715,158 | B1 | 4/2004 | Hay | |
| 6,874,168 | B1 | 4/2005 | Kuhuski | |
| 6,928,665 | B1 | 8/2005 | Yates | |
| 7,089,601 | B2 * | 8/2006 | Chen | A41B 9/001 2/400 |
| 7,704,120 | B2 * | 4/2010 | Chen | A41B 9/001 2/466 |
| 7,707,659 | B2 | 5/2010 | Africa et al. | |
| 8,042,197 | B2 | 10/2011 | Maier | |
| 8,312,569 | B2 | 11/2012 | Myers et al. | |
| 2006/0191052 | A1 * | 8/2006 | Bulian | 2/23 |
| 2006/0277662 | A1 * | 12/2006 | Coccia | 2/300 |
| 2007/0186328 | A1 * | 8/2007 | Bulian | 2/69 |
| 2007/0226869 | A1 * | 10/2007 | Maier | 2/69 |
| 2008/0229486 | A1 * | 9/2008 | Maier | 2/401 |
| 2012/0216337 | A1 | 8/2012 | Nelson | |

FOREIGN PATENT DOCUMENTS

| | | |
|---|---|---|
| WO | 2007126425 | 11/2007 |

* cited by examiner

*Primary Examiner* — Katharine Gracz
(74) *Attorney, Agent, or Firm* — Florek & Endres PLLC

(57) ABSTRACT

An undergarment wherein the back side comprises a pad disposed in the left side and a pad disposed in the right side and methods of improving comfort while sitting or to relieving, reducing, minimizing or eliminating discomfort or pain from sitting in men with prostate conditions by wearing or providing the undergarment.

6 Claims, 7 Drawing Sheets

PADDED UNDERGARMENT

FIELD OF THE INVENTION

The present invention relates to a padded undergarment for relieving, reducing, minimizing or eliminating the discomfort or pain associated with prolonged sitting in men with prostate conditions.

BACKGROUND OF THE INVENTION

The prostate is a small organ found only in men that surrounds the urethra and is located just below the bladder. For men under the age of 50, a common prostate condition is prostatitis whereas in men over 50, a common prostate condition is prostate enlargement, also known as benign prostate hyperplasia (BPH). In all, it is estimated that prostate conditions affect over 50% of men by age 50 and over 75% of men by age 80.

Men with prostate conditions often experience discomfort or pain while sitting, particularly when seated for prolonged periods of time. In order to alleviate this discomfort, it is common to employ seat cushions or pillows placed under the buttocks. While such measures are adequate in the privacy of one's own home, it is cumbersome, impractical and embarrassing to use a seat cushion or pillow at work or in public.

Accordingly, a need exists for a convenient and discrete way to alleviate the discomfort associated with prolonged sitting in men with prostate conditions. The prior art describes several examples of cushioned undergarments as seen in U.S. Pat. Nos. 4,969,216; 5,103,505; and 8,042,197. However, the undergarments of the prior art are not designed to define an unpadded area corresponding to substantially the entirety of the wearer's perineal region to thereby reduce or eliminate contact to the perineal region of the wearer. Thus, while padding corresponding to the perineal region of the wearer provides cushioning to the area it also has the downside of creating a point of contact and pressure with the perineal region while the wearer is seated, the present invention seeks to eliminate all points of contact and pressure with the perineal region of the wearer while the wearer is seated.

SUMMARY OF THE INVENTION

It is an object of the present invention to provide a padded undergarment, and methods for its use, which is convenient and discrete.

It is an additional object of the present invention to provide a padded undergarment, and methods for its use, that reduces, relieves or eliminates pressure on internal organs of the body, such as the prostate.

It is also an object of the present invention to provide a padded undergarment, and methods for its use, that reduces, relieves or eliminates pain or discomfort from hemorrhoids, injuries to the perineal region, surgery to the perineal region, or sutures in the perineal region such as from an episiotomy.

It is a further object of the present invention to provide a padded undergarment, and methods for its use, that reduces, relieves or eliminates pressure points by raising sensitive areas of the body away from the source of the pressure, rather than placing cushioning between the sensitive areas and the source of the pressure.

It is still a further object of the present invention to provide a padded undergarment that defines an unpadded area corresponding to substantially the entirety of the wearer's perineal region.

Additional objectives, advantages and novel features of the invention will be set forth in part in the description which follows, and in part will become apparent to those skilled in the art upon examination of the following, or may be learned by practice of the invention.

The present invention is directed generally to an undergarment having a front side and back side, connected by a crotch portion, a waistband, and two leg portions, corresponding to the left and right legs of a wearer, whereby the two leg portions define a left side and a right side of the undergarment, and wherein the back side comprises a pad disposed in the left side and a pad disposed in the right side. In an embodiment of the present invention, the undergarment is pants, shorts, boxer shorts or boxer briefs, with boxer shorts or boxer briefs being preferred.

When the undergarment of the present invention is worn and the wearer is in a seated position, the pads raise the perineal region of the wearer of the undergarment from the surface of the seat to thereby minimize pressure on the perineal region of the wearer while also providing comfort and cushioning to the area of the wearer's buttocks in contact with the seat. Accordingly, the pads of the present invention should be shaped and configured so as to define a space between the pads such that, when worn, the space corresponds approximately to substantially the entirety of the perineal region of the wearer. The space defined by the pads should be a substantially unpadded area between the concave edges of the pads, which is intersected by the imaginary vertical line 24 of symmetry, with the exception of any cushioning provided by the material used for the undergarment itself. However, it is understood that the space defined by the pads may contain other such padding provided that the other padding does not bear any substantial amount of the wearer's weight when in a seated position.

An additional embodiment of the present invention is directed to a method for improving the comfort to a person while sitting by providing or wearing an undergarment having a front side and back side, connected by a crotch portion, a waistband, and two leg portions, corresponding to the left and right legs of a wearer, whereby the two leg portions define a left side and a right side of the undergarment, and wherein the back side comprises a pad disposed in the left side and a pad disposed in the right side.

A further embodiment of the present invention is directed to a method for relieving, reducing, minimizing or eliminating discomfort or pain while sitting in men with prostate conditions by wearing an undergarment having a front side and back side, connected by a crotch portion, a waistband, and two leg portions, corresponding to the left and right legs of a wearer, whereby the two leg portions define a left side and a right side of the undergarment, and wherein the back side comprises a pad disposed in the left side and a pad disposed in the right side.

A still further embodiment of the present invention is directed to a method for relieving, reducing, minimizing or eliminating discomfort or pain while sitting in men with prostate conditions comprising wearing or providing to the man an undergarment having padding that is configured to raise the perineal region of the man away from a surface when the man is seated thereon.

DETAILED DESCRIPTION

Figure 1:
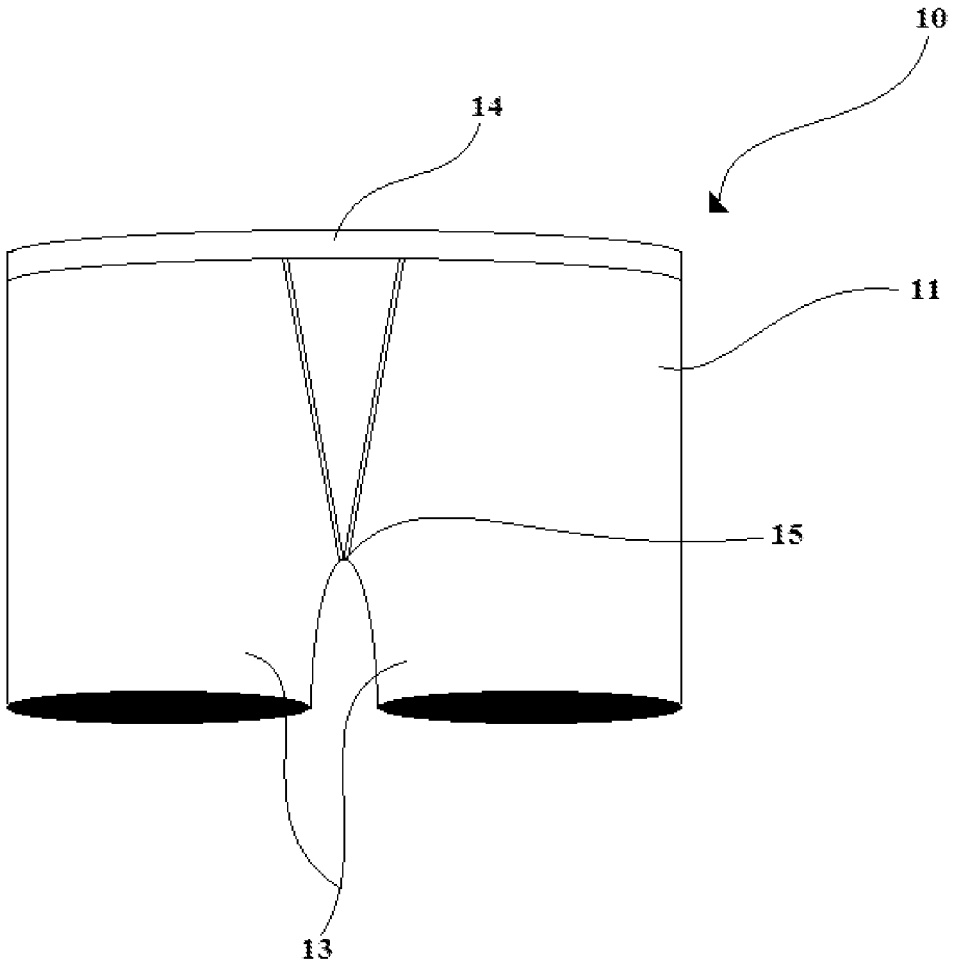
FIG. 1 is a perspective view of the front side of an embodiment of the undergarment of the present invention.

In an embodiment of the present invention, shown in accompanying FIGS. 1-6, the undergarment 10 is formed of a front side 11 and back side 12, connected by a crotch portion 15, a waistband 14, and two leg portions 13, corresponding to the left and right legs of a wearer, whereby the two leg portions 13 define a left side and a right side of the undergarment 10. The back side 12 comprises a first pad 16 disposed in the left side and a second pad 16 disposed in the right side. In an embodiment of the present invention, the leg portions 13 extend in length below the crotch portion 15.

Figure 7:
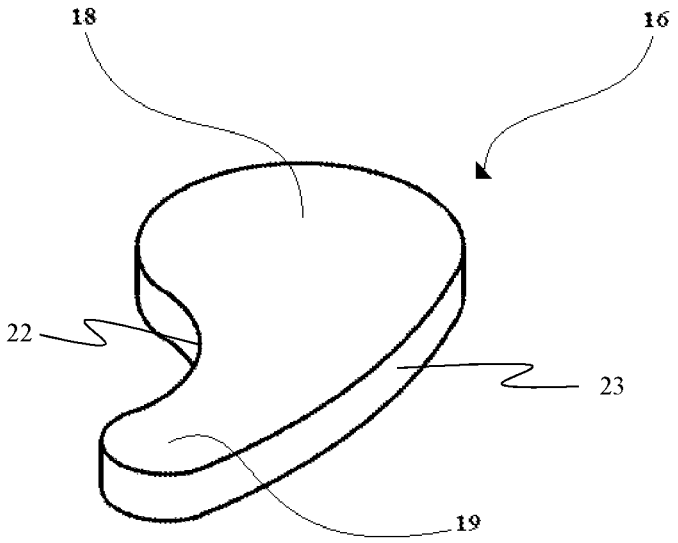
FIG. 7 is a perspective view of a pad of the present invention.

The pads 16 may be a variety of shapes including circular, oval-shaped, triangular, rectangular, diamond-shaped, crescent-shaped or annular. In a preferred embodiment, the pads 16 are comma-shaped to have a wider upper portion 18, defining a top edge of the pad, that tapers down to a narrower lower portion 19, defining a bottom edge of the pad, and which together thereby define external concave and convex edges 22, 23 of the pads 16 as shown in FIG. 7. In this embodiment, the ratio of the widest dimension of the wider upper portion 18 of the pads 16 to the narrowest dimension of the narrower lower portion 19 of the pads 16 should he from about 1.5:1 to about 4:1, preferably from about 2:1 to about 3:1 and most preferably about 3:1.The pads 16 may also be scored or segmented into smaller units placed from about 1 mm to about 15 mm apart. The scoring or segmentation allows the pads 16 to more readily bend to the contours of the body of the wearer of the undergarment 10, particularly when the wearer is in a seated position.

The pads 16 are disposed in the undergarment 10 such that they are symmetrical about an imaginary vertical line 24 separating the left side and right side of the undergarment into two approximately equal halves whereby the concave edge of each pad 16 faces inwardly directed toward the vertical line 24. It is preferred, although not required, that the pads do not touch or intersect at any point. Thus, at their closest point, the pads 16 should be spaced from about 0.5 to about 3 inches apart, preferably about 1 to about 2 inches apart, and more preferably about 1, about 1.25 or about 1.5 inches apart. At their furthest point, the pads 16 should be spaced from about 2.5 to about 6 inches apart, preferably about 3 to about 5 inches apart, and more preferably about 3.5, about 4 or about 4.5 inches apart. Additionally, the pads 16 are closer together at their upper portions 18 than at their lower portions 19. In particular, the distance between the closest points between the lower portions 19 of the pads 16 is about 2 to about 5 times greater than the distance between the closest points between the upper portions 18 of the pads 16, preferably about 3 to about 4.5 times greater, more preferably about 3.5 to about 4.25 times greater and most preferably about 4 times greater. The pads 16 are oriented in the undergarment 10 with their wider portions above their narrower portions and with their concave edges facing inwardly.

Figure 2:
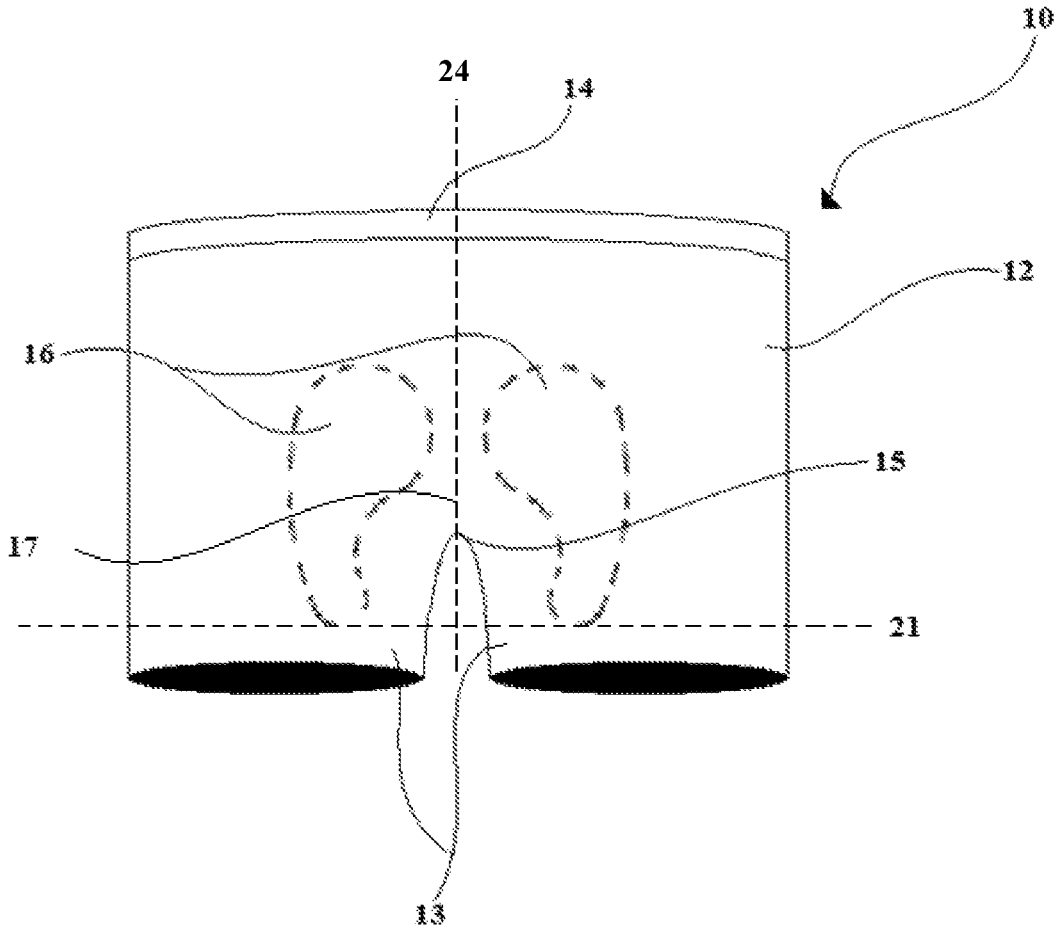
FIG. 2 is a perspective view of the back side of an embodiment of the undergarment of the present invention.
Figure 3:
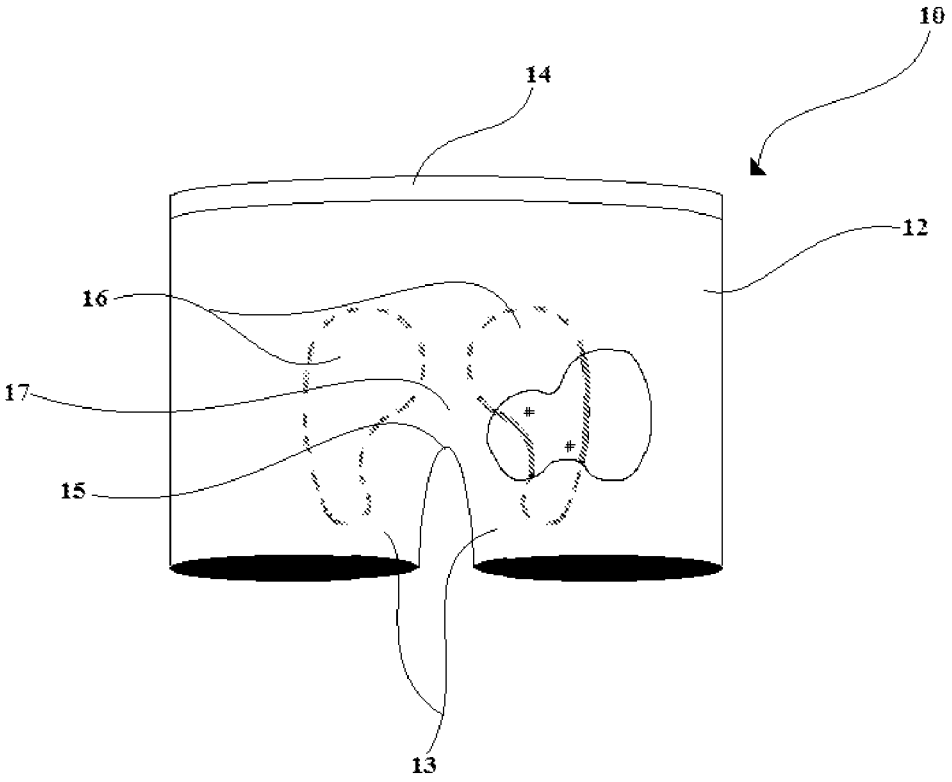
FIG. 3 is a perspective view of the back side of an embodiment of the undergarment of the present invention containing a cutout to show a pad disposed in the undergarment.

As shown in FIG. 2, the pads 16 are positioned such that a line 21 intersecting the bottom-most part of the first pad 16 and intersecting the bottom-most part of the second pad 16 extends over the gap between the leg portions 13.

The pads 16 are also of a suitable thickness to impart cushioning to the buttocks of the wearer of the undergarment 10. Therefore, each pad 16 should have a thickness between first and second surfaces of from about 5 to about 30 mm, preferably about 10 to about 25 mm and more preferably about 15 to about 20 mm. It should be understood that a heavier wearer will require thicker padding than a lighter wearer to ensure that the pads 16 are not substantially compressed by the weight of the wearer. It is within the level of skill of a person of ordinary skill in the art to select a suitable padding thickness based on the weight of the wearer.

In an embodiment of the present invention, the pads 16 may be affixed to the back side 12 on its inner surface, i.e., the surface of the back side 12 that is toward a wearer's body, or its outer surface, i.e., the surface of the back side 12 that is away from a wearer's body. In this embodiment, the pads 16 can be affixed to the back side 12 by stitching, adhesives, tapes, hook and loop fasteners, clips, magnets and the like. It is preferred that the pads 16 be unitarily formed with the back side 12 using stitching or adhesives. In another embodiment, the pads 16 can be affixed to the back side 12 by placing a layer of fabric or other textile over and around each of the pads 16, either individually or together, and affixing the layer to the back side 12 by stitching or adhesives. In an additional embodiment, the pads 16 can be affixed to a separate layer of fabric or other textile, either individually or together, and the separate layer is then affixed to the back side 12 using any of the methods described above.

Figure 4:
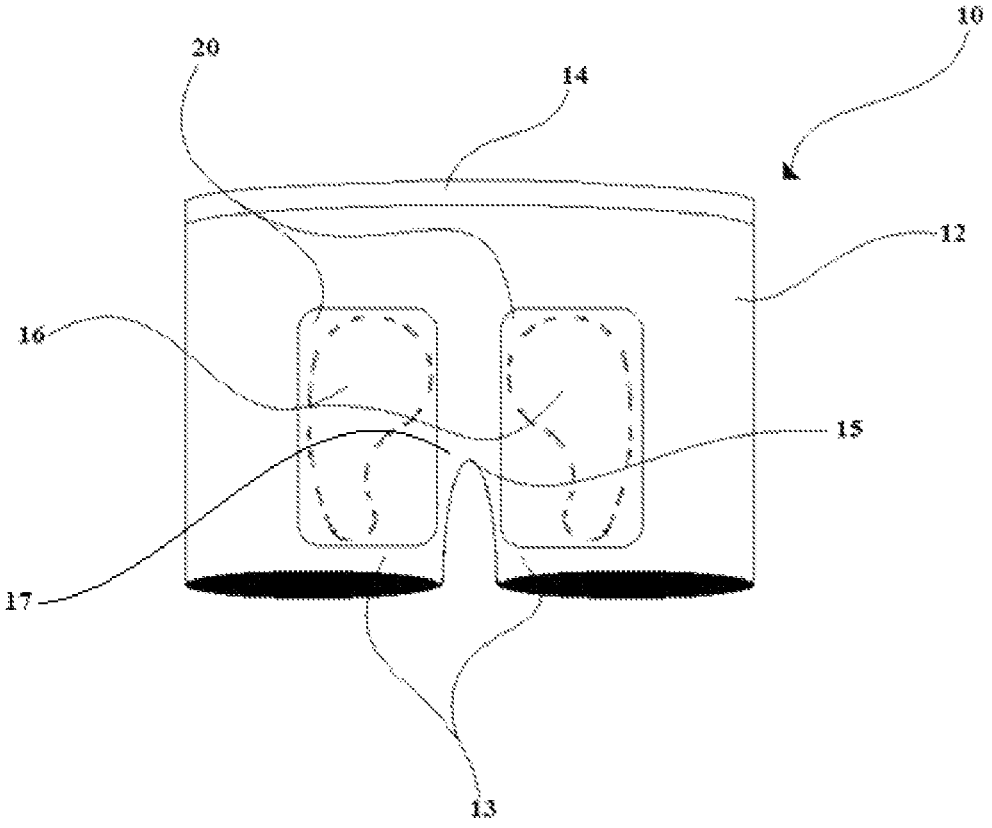
FIG. 4 is a perspective view of the back side of an embodiment of the undergarment of the present invention.
Figure 5:
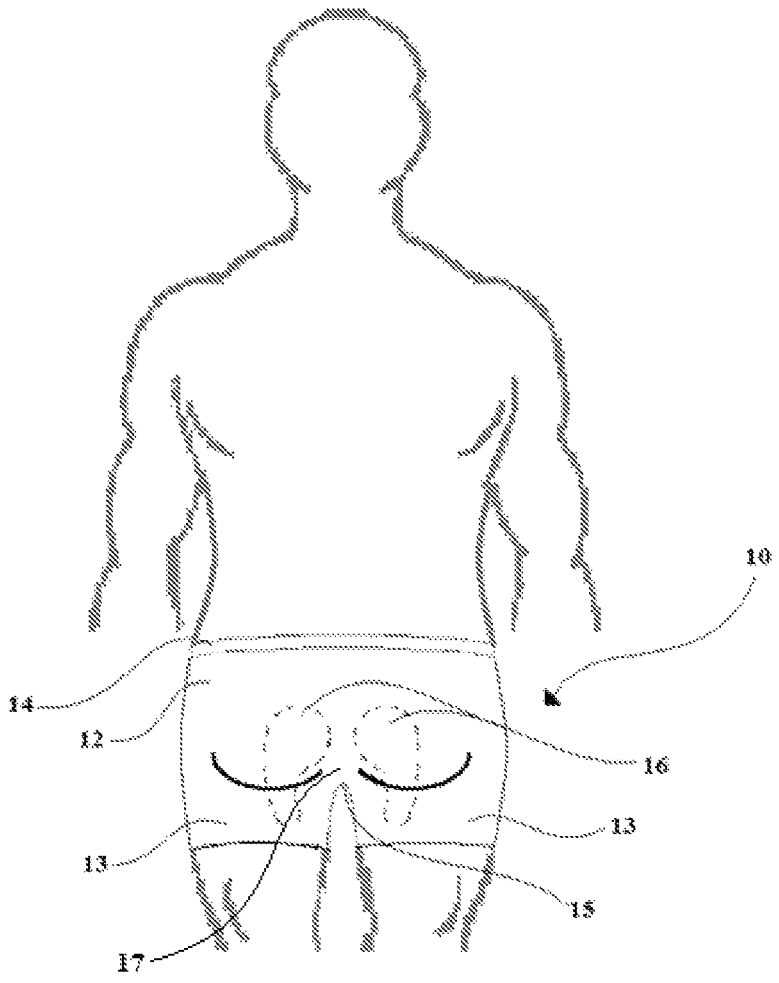
FIG. 5 is a side view of the back side of an embodiment of the undergarment of the present invention when worn.
Figure 6:
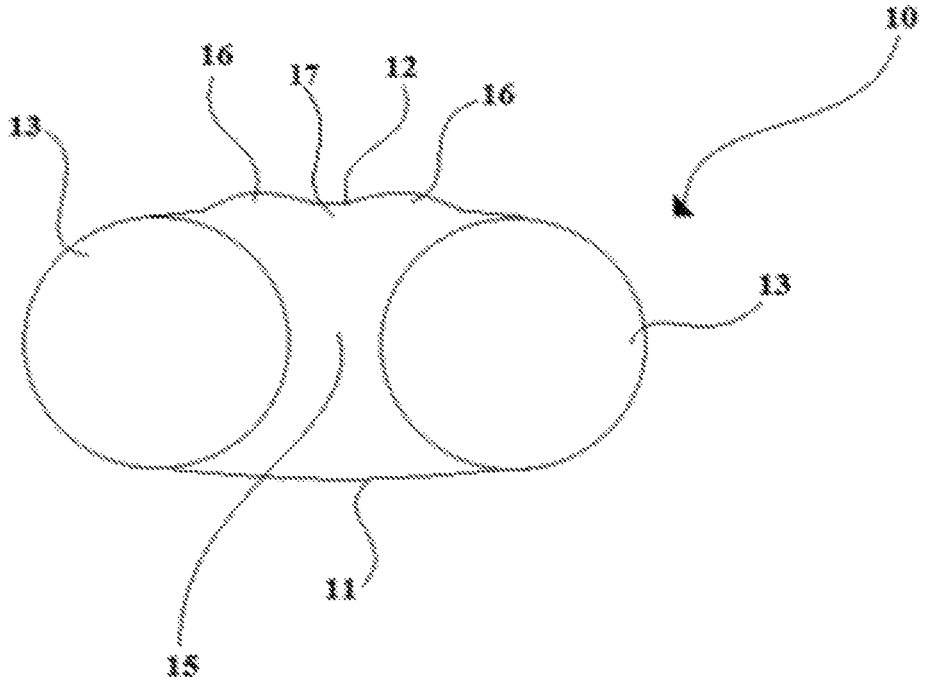
FIG. 6 is a bottom view of an embodiment of the undergarment of the present invention.

In an alternative embodiment of the present invention, pockets 20 are made on the inner surface or outer surface of the backside 12 as shown in FIG. 4. The pockets 20 allow the pads 16 to be inserted or replaced into the undergarment 10 when the undergarment 10 is being worn. The pads 16 can then be removed from the undergarment 10 when they are not required or when the undergarment 10 is being washed or cleaned. The pockets 20 may be configured so that the pads 16 can be inserted in their entirety into their respective pocket 20 or so that at least a portion of the pads 16 can be inserted that is substantial enough to keep the pads in place when the undergarment 10 is being worn.

The wider upper portions 18 of the pads 16 are situated at about midway between the waistband 14 and the bottom of the leg portions 13, which corresponds to about the vertical center of the buttocks of a wearer of the undergarment 10, and extend down the leg portions 13 to an area past the gluteal fold of the wearer which corresponds to about the upper thigh or upper hamstring of a wearer of the undergarment 10. it is preferred that the wider upper portions 18 of the pads 16 are located in an area of the undergarment 10 corresponding to the posterior proximal end of the femurs of the wearer when the wearer is in a seated position and the narrower lower portions 19 of the pads 16 are located in an area of the undergarment 10 corresponding to an area below the gluteal fold of the wearer. Thus, at least the bottom edge of the narrower lower portion 19 of the pads 16 should extend to, and terminate down, opposite leg portions 13, i.e., the lower portion 19 of one of the pads 16 extends to, and terminates down, the left leg portion 13, and the lower portion 19 of the other pad 16 extends to, and terminates down, the right leg portion 13.

The pads 16 are configured to extend from the buttocks of a wearer along and down the backs of the legs of the wearer. Accordingly, it is preferred, although not required, that the pads 16 do not wrap around to the sides of the leg portions 13 or into the crotch portion 15 as this could cause unwanted pressure on the sensitive perineal region. Put differently, the entire first or second surfaces of each of the pads 16 should be substantially coplanar, on a plane corresponding to the back of a wearer's body, and should not extend toward the front of the undergarment 10 along the areas of the undergarment 10 corresponding to the perineal region or upper thighs of a wearer when the undergarment is in an unworn and unfolded configuration.

The pads 16 are shaped and configured so as to define a space 17 between the pads 16 such that, when worn, the space 17 corresponds approximately to the perineal region of a wearer of the undergarment 10. It is preferred that the space 17 defined by the pads 16 is oval or circular shaped, although the space 17 may be triangular, rectangular or diamond-shaped as well. The space 17 defined by the pads 16 prevents the perineal region of the wearer's body from contacting or receiving significant pressure from the surface upon which the wearer is seated.

It is also contemplated that a heating element be placed in the space 17 defined by the pads 16. The heating element can be unitarily formed with the undergarment 10 or be removeably placed in a pocket located at the space 17. The heating element can be any such element capable of producing a temperature between about 100° F. to about 200° F., preferably about 100° F. to about 150° F. and most preferably about 100° F. to about 130° F. Suitable heating elements include electrical heating elements that receive power from a wall outlet or batteries, heating elements that produce an exothermic reaction, heating elements that can be heated by an outside source such as a microwave, oven or hot liquid, heating elements employing a supersaturated solution, and the like.

The pads 16 relieve, reduce, minimize or eliminate pressure to the perineal region of the wearer's body by raising the perineal region away from the seated surface, thereby taking a significant portion of the wearer's weight off his perineal region and distributing the wearer's weight over the area of the pads 16. Thus, the pads 16 serve the dual function of raising the wearer's perineal region from the seated surface, while also providing cushioning to the areas of the wearer's buttocks adjacent to the pads 16 that are now receiving the majority of the pressure from the weight of the wearer's body. It is therefore understood that the pads 16 reduce pressure to the perineal region by positioning the pads 16 so that they are adjacent to the perineal region rather positioned over the perineal region.

The pads 16 may be formed of any material that can impart cushioning to the buttocks of the wearer of the undergarment 10 while also being resilient enough to hold the weight of the wearer's body without flattening to such an extent that the wearer's perineal region would contact the surface upon which the wearer is seated. Suitable materials include cotton, synthetic fibers, foam, memory foam, rubber, silicone and urethane. Silicone and urethane are particular preferred for the pads 16.

The undergarment 10 may be made from any suitable material such as cotton, polyester, spandex or combinations thereof. It is preferred that the undergarment 10 be made of a cotton or cotton/polyester knit or contain spandex or elastic so that the undergarment 10 is stretchable and will conform to the contours of the wearer's body in the fashion of a boxer brief so that the pads 16 maintain proper positioning. The waistband 14 lightly cinches the undergarment 10 to the waist of the wearer and can therefore be made from any suitable stretchable material such as spandex, elastic or rubber.

Also provided by the present invention is a method for improving the comfort to a person while sitting, the method having the step of wearing, or providing to the person, an undergarment 10 in accordance with the present invention as described above.

Additionally provided by the present invention is a method for relieving, reducing, minimizing or eliminating discomfort or pain while sitting in men with prostate conditions by wearing, or providing to the man, an undergarment 10 in accordance with the present invention as described above. In an embodiment of this method of the present invention the prostate condition is prostatitis, BPH and/or prostate cancer.

Further provided by the present invention is a method for relieving, reducing, minimizing or eliminating discomfort or pain while sitting in men with prostate conditions by wearing or providing to the man an undergarment having padding that is configured to raise the perineal region of the man away from a surface when the man is seated thereon. The padding defines an unpadded area corresponding substantially to the entirety of the pernieal region of the man and is therefore of a sufficient thickness such that there are no points of contact between the perineal region of the man and the surface upon which he is seated. It is preferred that the padding only be of the minimum thickness required such that an amount of pressure from the weight of the man is distributed from his perineal region to the areas of his buttocks and legs adjacent to the padding sufficient to produce relief, a reduction, a minimization or an elimination of the discomfort or pain caused from sitting. Accordingly, the padding should have a thickness of from about 5 to about 30 mm, preferably about 10 to about 25 mm and more preferably about 15 to about 20 mm. In an embodiment of this method of the present invention the prostate condition is prostatitis, BPH and/or prostate cancer. It is also understood that the undergarment used for the present method may include any combination of the features described above for the undergarment 10.

The methods described herein are able to provide relief from pressure to an internal organ/area of the wearer's body by redistributing the wearer's weight to an area adjacent to and bounding the sensitive areas of the wearer's body where little or none of the force of the wearer's weight is desired. Thus, it should be understood that by applying pressure to a certain external area of the wearer's body discomfort or pain will be felt on an internal area of the wearer's body corresponding to the external area, which the present methods are directed towards relieving, reducing, minimizing or eliminating such discomfort or pain.

Moreover, additionally provided by the present invention is a method for relieving, reducing, minimizing or eliminating discomfort or pain while sitting in a person having hemorrhoids, injury to the perineal region, surgery to the perineal region or sutures in the perineal region such as from an episiotomy by wearing, or providing to the person, an undergarment 10 in accordance with the present invention as described above.

Variations, modifications and alterations to the above detailed description will be apparent to those skilled in the art. All such variations, modifications and/or alternatives are intended to fall within the scope of the present invention, limited only by the claims. All cited patents and publications are hereby incorporated by reference.

The invention claimed is:

1. A method of reducing discomfort or pain in a human subject with a prostate condition comprising:

(a) wearing on the subject an undergarment having a front side and back side connected by a crotch portion, a waistband, and two leg portions, corresponding to left and right legs of the subject, whereby the two leg portions define a left side and a right side of the undergarment, the undergarment comprising:

a first pad disposed in the left side of the back side and a second pad disposed in the right side of the back side such that the first and second pads are symmetrical about a vertical line separating the left side and the right side of the back side, each of the first and second pads shaped in a comma-shape and comprising an external concave edge defining an upper wider portion that tapers to a lower narrower portion, and an unpadded area on the back side defined between the concave edges of the first and second pads, whereby the unpadded area is intersected by the vertical line, wherein the first and second pads are oriented such that their concave edges are directed toward the vertical line, wherein at least a bottom edge of the lower narrower portion of the first pad extends down into the left leg portion and at least a bottom edge of the lower narrower portion of the second pad extends down into the right leg portion such that a line intersecting the bottom edge of the first pad and intersecting the bottom edge of the second pad extends over a gap between the left leg portion and the right leg portion, and wherein an entire first surface of the first pad and an entire first surface of the second pad are coplanar when the undergarment is in an unworn and unfolded configuration, (b) positioning the first and second pads adjacent a perineal region of the subject whereby, when the subject is seated on a surface, the entire perineal region of the subject corresponds to the unpadded area defined between the concave edges of the first and second pads, (c) positioning at least the bottom edge of the lower narrower portion of the first pad to an area below a first gluteal fold of the subject and positioning at least the bottom edge of the lower narrower portion of the second pad to an area below a second gluteal fold of the subject, whereby, when the subject is seated on the surface, the perineal region of the subject is raised from the surface such that a portion of weight of the subject is reduced over the perineal region and distributed over the first and second pads.

2. The method of claim 1 wherein the prostate condition is prostatitis, benign prostatic hyperplasia, or prostate cancer.

3. The method of claim 1 wherein the first surfaces of the first pad and second pad do not wrap around toward the front of the undergarment.

4. The method of claim 1 wherein the entire first surface of the first pad and the entire first surface of the second pad lie on a plane corresponding to the back side when the undergarment is in an unworn and unfolded configuration.

5. The method of claim 1 wherein the first and second pads are not circular or oval shaped.

6. The method of claim 1 wherein a distance at a closest point between the lower narrower portions of the first and second pads is 2 to 5 times greater than a distance at a closest point between the upper wider portions of the first and second pads.

* * * * *